US009373461B2

(12) United States Patent
Hozumi

(10) Patent No.: US 9,373,461 B2
(45) Date of Patent: Jun. 21, 2016

(54) SWITCH UNIT

(71) Applicant: OMRON CORPORATION, Kyoto-shi (JP)

(72) Inventor: Akihiro Hozumi, Okayama (JP)

(73) Assignee: OMRON Corporation, Kyoto (JP)

( * ) Notice: Subject to any disclaimer, the term of this patent is extended or adjusted under 35 U.S.C. 154(b) by 76 days.

(21) Appl. No.: 14/283,926

(22) Filed: May 21, 2014

(65) Prior Publication Data

US 2015/0001055 A1 Jan. 1, 2015

(30) Foreign Application Priority Data

Jun. 27, 2013 (JP) ..... 2013-135456

(51) Int. Cl.

| | |
|---|---|
| ***H01H 13/06*** | (2006.01) |
| ***H01H 9/04*** | (2006.01) |
| *H01H 1/58* | (2006.01) |
| *H01H 9/06* | (2006.01) |
| *H01H 13/08* | (2006.01) |

(52) U.S. Cl.

CPC ..... *H01H 13/06* (2013.01); *H01H 9/04* (2013.01); *H01H 1/58* (2013.01); *H01H 9/06* (2013.01); *H01H 13/08* (2013.01); *H01H 2223/002* (2013.01)

(58) Field of Classification Search

CPC ... H01H 2223/002; H01H 1/58; H01H 13/08; H01H 9/06; H01H 13/06; H01H 9/04

USPC ..... 200/302.2, 302.1, 302.3, 333, 332.2, 200/505, 520, 323, 325

See application file for complete search history.

(56) References Cited

U.S. PATENT DOCUMENTS

| | | | | |
|---|---|---|---|---|
| 4,638,275 | A | 1/1987 | Belbel | |
| 8,193,458 | B2 * | 6/2012 | Hozumi | B25B 21/00 200/1 V |
| 8,809,712 | B2 * | 8/2014 | Kobayashi | H01H 9/06 200/306 |
| 2008/0210046 | A1 | 9/2008 | Perini | |
| 2012/0234657 | A1 | 9/2012 | Nishikimi et al. | |

FOREIGN PATENT DOCUMENTS

| | | | |
|---|---|---|---|
| DE | 4419794 | A1 | 12/1995 |
| GB | 1220648 | | 1/1971 |
| JP | 2012150916 | A | 8/2012 |
| JP | 2012206248 | A | 10/2012 |

OTHER PUBLICATIONS

European Search Report for corresponding application EP14169621; Report dated Sep. 9, 2014.

* cited by examiner

*Primary Examiner* — Edwin A. Leon

(74) *Attorney, Agent, or Firm* — Klarquist Sparkman, LLP

(57) ABSTRACT

A switch unit including a case that has an opening and a switch, two terminals that partially project to an outside of the case from the opening, a gasket configured to seal the opening, the gasket including two through-holes through which the terminals extend, a base member, and a pressing member that is arranged between the terminals, where the gasket is in close contact with the terminals at the through-holes, a region between the through-holes of the gasket is pressed while nipped between the pressing member and the base member, and a surrounding region in the gasket is pressed while nipped between an inside surface of the case and the base member.

17 Claims, 8 Drawing Sheets

A-A

SWITCH UNIT

CROSS REFERENCE TO RELATED APPLICATION

This application is related to and claims the benefit of Japanese Patent Application Number 2013-135456 filed on 27 Jun. 2013, the contents of which are herein incorporated by reference in their entirety.

BACKGROUND

1. Field

The present invention relates to a switch unit.

2. Related Art

Conventionally, a trigger switch includes a case provided with a switch and an operation part used to operate the switch. For example, the switch is turned on and off by pressing the operation part (trigger) onto an inside of the case. For example, a trigger switch controls a power supplied to a motor of an electric power tool. The trigger switch is connected to the motor outside the case by a lead wire. Liquid-tightness (a property preventing the invasion of liquid) at a connection point to the lead wire is required for the case in order to prevent invasion of a liquid streaming on the lead wire.

Japanese Unexamined Patent Publication No. 2012-206248 discloses a trigger switch in which a waterproof property of the case is considered. Japanese Unexamined Patent Publication No. 2012-206248 discloses a configuration in which a portion through which the lead wire is drawn from the case of the trigger switch is filled with an adhesive. Japanese Unexamined Patent Publication No. 2012-206248 further discloses a configuration in which a motor connection terminal to which the lead wire is connected is covered with a packing.

However, in the conventional technologies, unfortunately workability is degraded because of many man-hours.

Time waiting for the filled or applied adhesive to be cured is required in the configuration in which the portion through which the lead wire is drawn is filled with the adhesive. Therefore, assembly workability of the trigger switch is degraded. A method for connecting the motor and the lead wire is restricted because the specific lead wire is caused to adhere to the trigger switch.

In the configuration in which the motor connection terminal is covered with the packing, after the lead wire is connected to the motor connection terminal, it is necessary to thread the lead wire through the packing to attach the packing to the trigger switch. Therefore, assembly man-hours increase in order to combine the trigger switch and the motor.

SUMMARY

A switch unit is provided including a case that has an opening and a switch, two terminals that partially project to an outside of the case from the opening, a gasket configured to seal the opening, the gasket including two through-holes through which the terminals extend, a base member, and a pressing member that is arranged between the terminals, where the gasket is in close contact with the terminals at the through-holes, a region between the through-holes of the gasket is pressed while nipped between the pressing member and the base member, and a surrounding region in the gasket is pressed while nipped between an inside surface of the case and the base member.

DETAILED DESCRIPTION

Hereinafter, an embodiment of the present invention will be described in detail with reference to the drawings.

Figure 1:
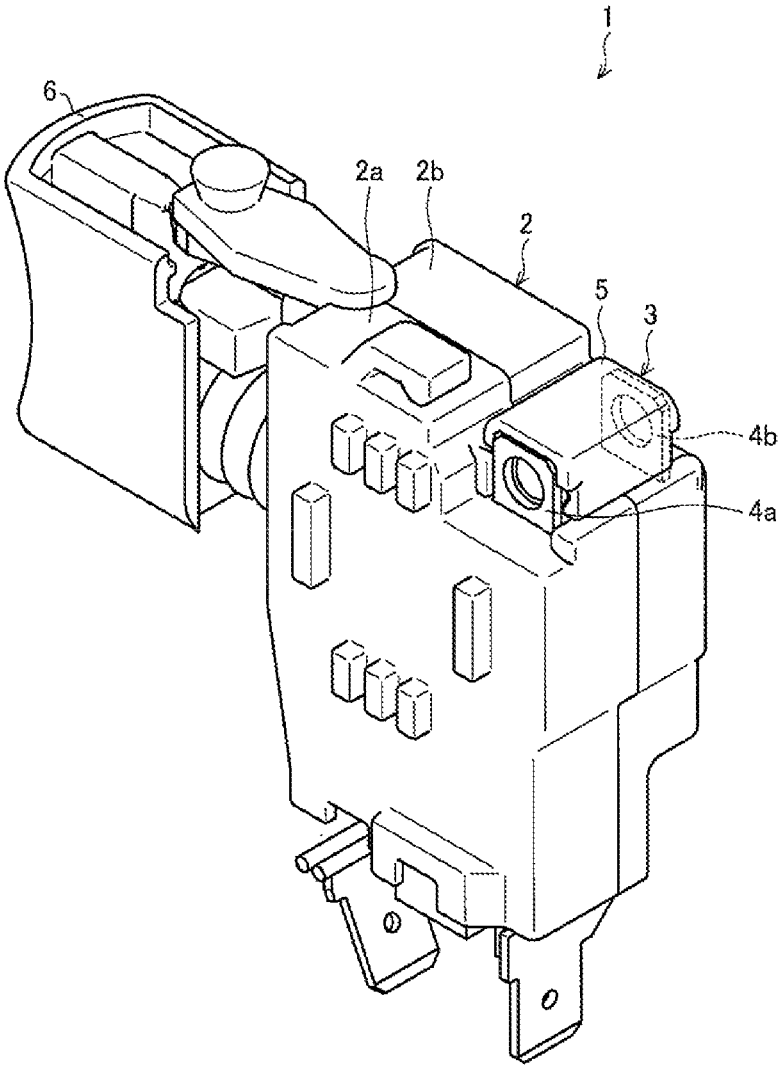
FIG. 1 is a perspective view illustrating a configuration of a trigger switch according to an embodiment of the present invention.
Figure 2:
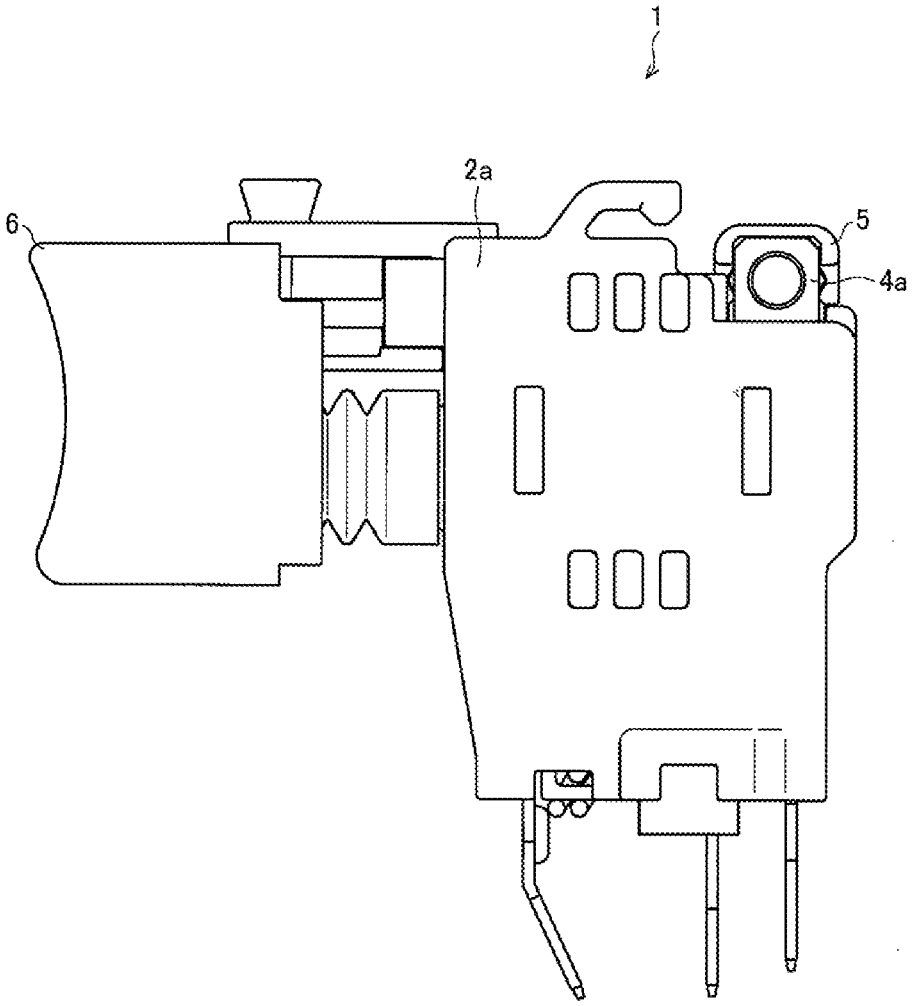
FIG. 2 is a front elevation illustrating the configuration of the trigger switch.

FIG. 1 is a perspective view illustrating a configuration of trigger switch 1 according to an embodiment of the present invention. FIG. 2 is a front elevation illustrating the configuration of trigger switch 1. Trigger switch 1 (switch unit) includes case 2, terminal unit 3, and operation part 6 (trigger). In case 2, a switch and a wiring board connected to the switch are incorporated. Operation part 6 (trigger) is for switching the switch between on and off from the outside of case 2. For example, trigger switch 1 is configured as a switch unit to be assembled in an electric power tool. Case 2 is configured by a combination of casing members 2*a* and 2*b*.

Terminal unit 3 includes external terminals 4*a* and 4*b* and pressing member 5. For example, each of external terminals 4*a* and 4*b* is a terminal to which a lead wire connected to a motor of the electric power tool is to be connected, and external terminals 4*a* and 4*b* are projected to the outside of case 2. External terminals 4*a* and 4*b* are symmetrically located with respect to pressing member 5. In case 2, external terminals 4*a* and 4*b* are connected to electric components such as the switch and the wiring board.

For example, in the case that the electric power tool is used in the rain, possibly a liquid (water) reaches external terminals 4*a* and 4*b* of trigger switch 1 through the lead wire connected to the motor. Therefore, there is a need to prevent the liquid from invading in case 2 from external terminals 4*a* and 4*b* projected outward from case 2. The switch unit can be used in not only the electric power tool but also other electric devices.

Figure 3:
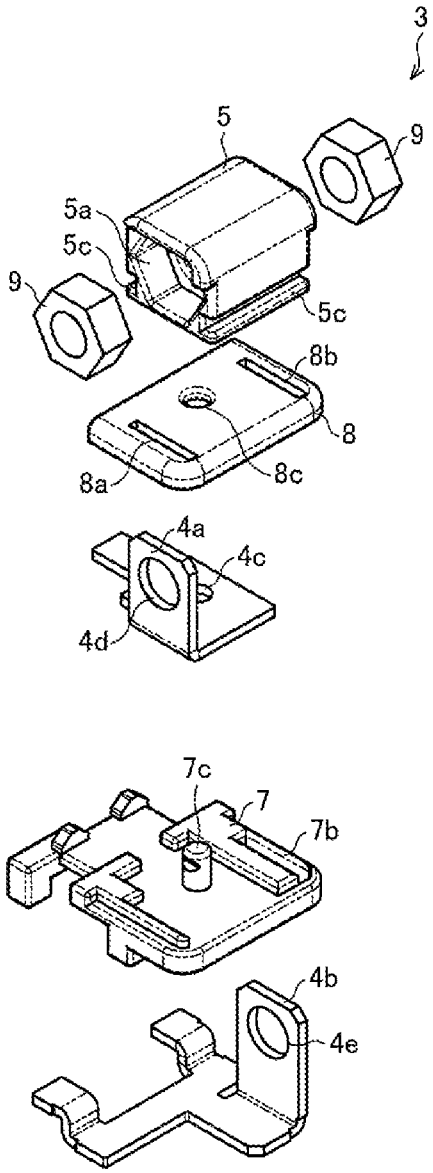
FIG. 3 is an exploded perspective view illustrating a configuration of a terminal unit of the trigger switch.

FIG. 3 is an exploded perspective view illustrating a configuration of terminal unit 3. Terminal unit 3 is an assembly in which two external terminals 4*a* and 4*b*, base member 7, gasket 8, pressing member 5, and two nuts 9 are combined.

External terminals 4*a* and 4*b* include holes 4*d* and 4*e*, respectively. In each of holes 4*d* and 4*e*, a bolt is inserted through a plate-like portion to which the lead wire is connected. External terminal 4*a* also includes positioning hole 4*c* made at a position that comes into contact with base member 7. External terminals 4*a* and 4*b* have conductivity, and are made of metal, for example. In this embodiment, each of external terminals 4*a* and 4*b* is formed by bending a sheet metal.

Base member 7 includes hole 7*b* through which external terminal 4*b* is inserted and positioning pin 7*c*. Pin 7*c* includes a groove in which pressing member 5 is temporarily fixed to a side surface of a column. For example, base member 7 has conductivity, and is made of plastic, for example.

Gasket 8 has a planar shape, and is an insulating seal member (packing) made of an elastic material such as rubber. Gasket 8 includes through-hole 8*a* through which external terminal 4*a* extends and through-hole 8*b* through which external terminal 4*b* extends. Through-holes 8*a* and 8*b* have rectangular shapes so as to fit to sectional shapes of external terminals 4*a* and 4*b* inserted therethrough. Gasket 8 also includes positioning hole 8*c* between through-holes 8*a* and 8*b*.

Pressing member 5 is a block having an insulating property, and is made of plastic, for example. Pressing member 5 includes recesses 5*a* so that nut 9 is accommodated in each side surface. Pressing member 5 includes a planar surface on the lower side in order to press a central portion of gasket 8. Pressing member 5 includes projections 5*c* for combining with casing members 2*a* and 2*b*.

Figure 4A:
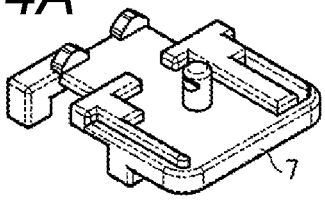
FIGS. 4A to 4E are perspective views illustrating an assembly procedure of the terminal unit.
Figure 4B:
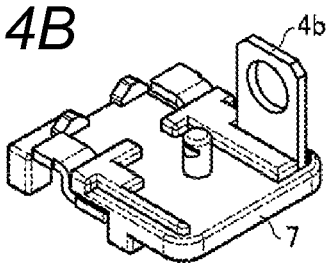
Figure 4C:
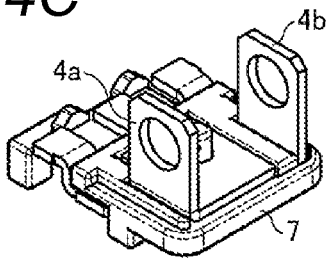
Figure 4D:
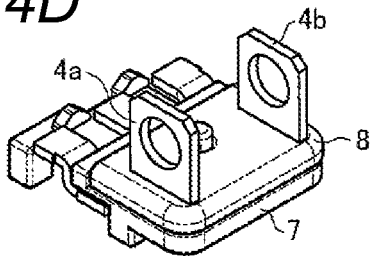
Figure 4D:
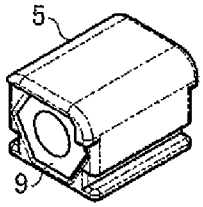
Figure 4E:
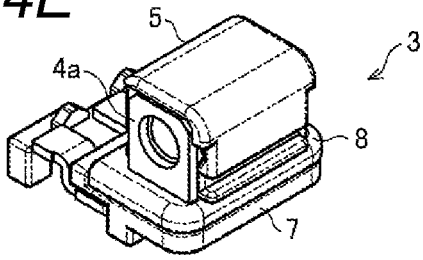
Figure 5A:
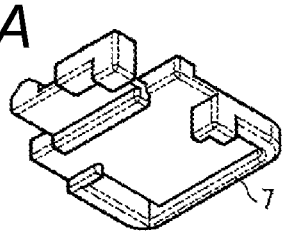
FIGS. 5A to 5E are perspective views illustrating an assembly procedure of the terminal unit.
Figure 5B:
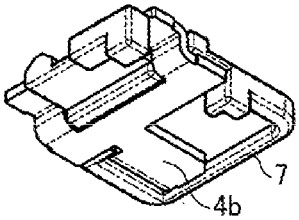
Figure 5C:
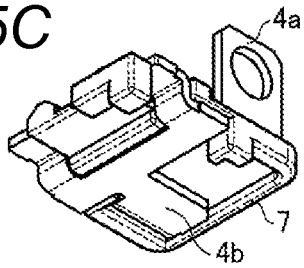
Figure 5D:
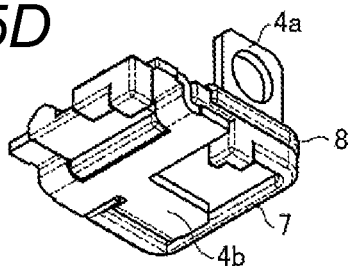
Figure 5D:
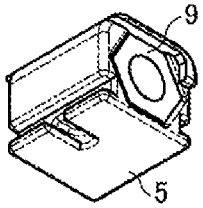
Figure 5E:
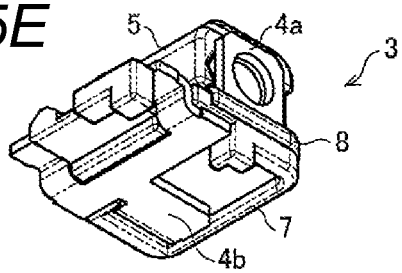

The assembly of terminal unit 3 will be described with reference to FIGS. 3 to 5E. FIGS. 4A to 4E and 5A to 5E are perspective views illustrating an assembly procedure of terminal unit 3. FIGS. 4A to 4E are perspective views illustrating base member 7 viewed from above. FIGS. 5A to 5E are perspective views illustrating base member 7 viewed from below. External terminal 4*b* is first inserted through hole 7*b* of base member 7 from the lower side of base member 7, so that external terminal 4*b* and base member 7 are combined (FIGS. 4B and 5B). External terminal 4*a* is arranged above base member 7 such that pin 7*c* of base member 7 is inserted through hole 4*c* of external terminal 4*a* (FIGS. 4C and 5C). Gasket 8 covers external terminals 4*a* and 4*b* and base member 7 such that external terminals 4*a* and 4*b* are inserted through through-holes 8*a* and 8*b* of gasket 8 (FIGS. 4D and 5D). Pressing member 5 in which nuts 9 are assembled in recesses 5*a* on both the side surfaces is arranged between external terminals 4*a* and 4*b* and on an upper surface of gasket 8 (FIGS. 4E and 5E). Pressing member 5 includes a notch in a lower surface thereof. Pin 7*c* in which the groove is formed is fitted in the notch to tentatively fix pressing member 5 to base member 7. Terminal unit 3 can be dealt with as one unit without being broken down. Therefore, terminal unit 3 facilitates the assembly of trigger switch 1. Because nuts 9 are located on the backsides of holes 4*c* of external terminals 4*a* and 4*b*, round terminals of lead wires can be fixed to external terminals 4*a* and 4*b* by the bolts.

Figure 6:
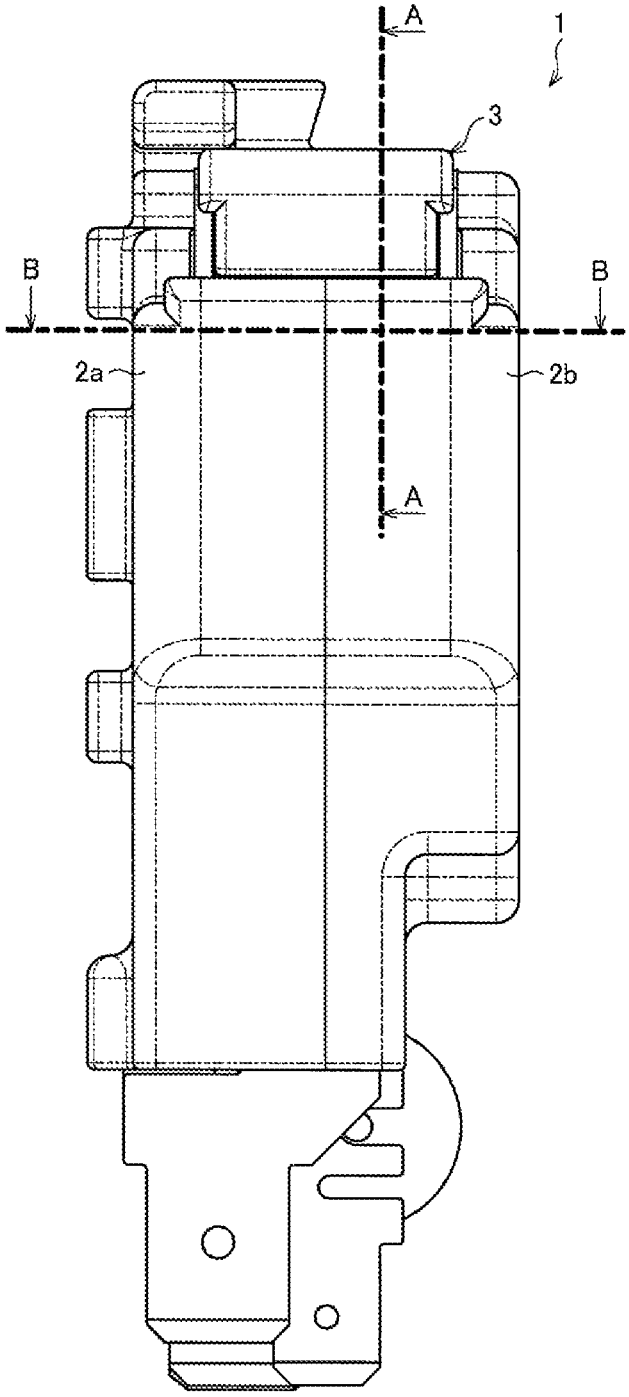
FIG. 6 is a side view illustrating a configuration of the trigger switch.
Figure 7:
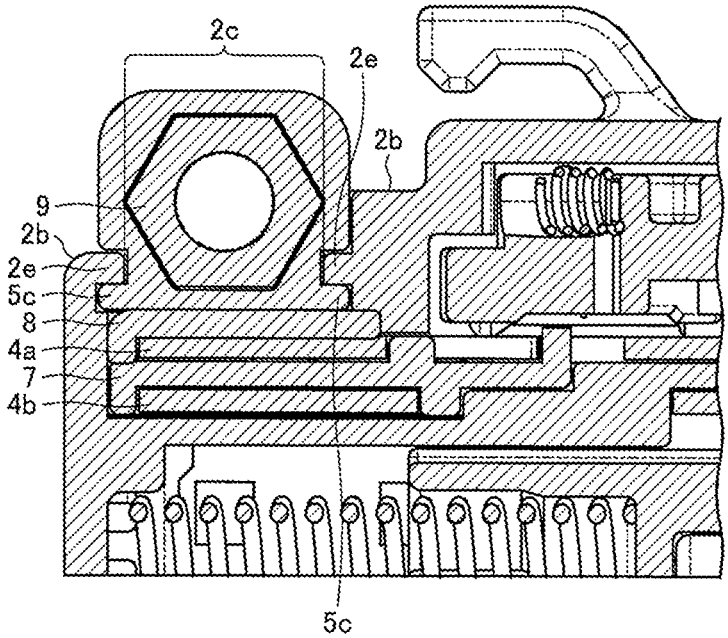
FIG. 7 is a sectional view taken in line A-A of FIG. 6.

FIG. 6 is a side view illustrating the configuration of trigger switch 1. FIG. 7 is a sectional view taken in line A-A of FIG. 6. Terminal unit 3 is attached to casing member 2*b* by slidably inserting terminal unit 3 in opening 2*c* casing member 2*b* (or casing member 2*a*) from the side surface of casing member 2*b*. Casing member 2*a* as another casing member is combined by sliding onto casing member 2*b* and terminal unit 3, which allows case 2 and terminal unit 3 to be assembled.

Each of casing members 2*a* and 2*b* includes projection 2*e* (an edge of the opening) engaging projection 5*c* of pressing member 5. A space in casing members 2*a* and 2*b* (a space where terminal unit 3 is arranged) is set such that a height of terminal unit 3 arranged inside is restricted. The height of at least base member 7 and gasket 8 overlapping each other is restricted. Specifically, the height of base member 7, external terminal 4*a*, gasket 8, and projection 5*c* of pressing member 5 overlapping one another is restricted. Therefore, projections 2*e* of casing members 2*a* and 2*b* press downwardly (toward gasket 8) on projections 5*c* of pressing member 5. Therefore, pressing member 5 is pressed against gasket 8 by casing members 2*a* and 2*b* (case 2). Note that terminal unit 3 is slid such that projections 2*e* of casing members 2*a* and 2*b* fit to the grooves of pressing member 5, whereby terminal unit 3 combines with casing member 2*b*.

Figure 8:
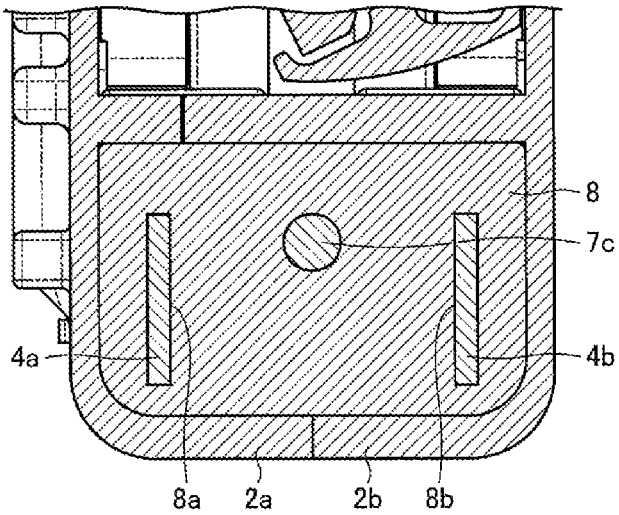
FIG. 8 is a sectional view taken in line B-B of FIG. 6.

FIG. 8 is a sectional view taken in line B-B of FIG. 6. FIG. 8 illustrates the section where gasket 8 is located. When the two side surfaces opposed to each other in gasket 8 are pressed toward the central direction by case 2, through-holes 8*a* and 8*b* of gasket 8 come into close contact with external terminals 4*a* and 4*b* piercing through-holes 8*a* and 8*b*, respectively. At this point, the side surfaces of four walls of gasket 8 are pressed toward the central direction of gasket 8 from a surrounding area by casing members 2*a* and 2*b* (case 2). Therefore, through-holes 8*a* and 8*b* of gasket 8 come into close contact with external terminals 4*a* and 4*b* piercing therethrough from all around. Accordingly, the liquids streaming on external terminals 4*a* and 4*b* can be prevented from invading in case 2 through through-holes 8*a* and 8*b* of gasket 8. Hole 8*c* of gasket 8 also comes into close contact with pin 7*c* piercing therethrough from all around.

The planar lower surface of pressing member 5 presses the central portion of the upper surface of gasket 8 such that the central portion of gasket 8 does not float due to deformation of gasket 8. Regions outward from through-holes 8*a* and 8*b* in the upper surface of gasket 8 are pressed by casing members 2*a* and 2*b* (case 2).

Figure 9:
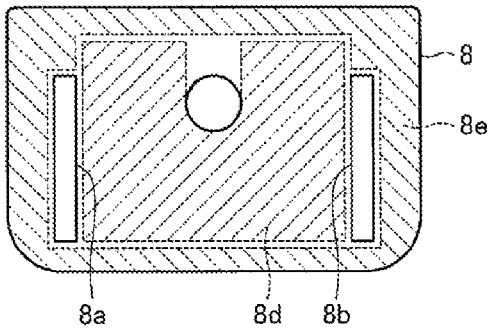
FIG. 9 is a plan view illustrating a configuration of a gasket of the trigger switch.

FIG. 9 is a plan view illustrating the configuration of gasket 8. When terminal unit 3 is assembled in case 2, region 8*d* between through-holes 8*a* and 8*b* is pressed against the planar lower surface of pressing member 5. In the upper surface of gasket 8, surrounding region 8*e* including the regions outward from through-holes 8*a* and 8*b* are pressed against inside surfaces of casing members 2*a* and 2*b* (case 2). Because the surroundings of through-holes 8*a* and 8*b* in gasket 8 are pressed by pressing member 5 and case 2, the liquid streaming on external terminals 4*a* and 4*b* cannot stream on the surface of gasket 8.

Figure 10:
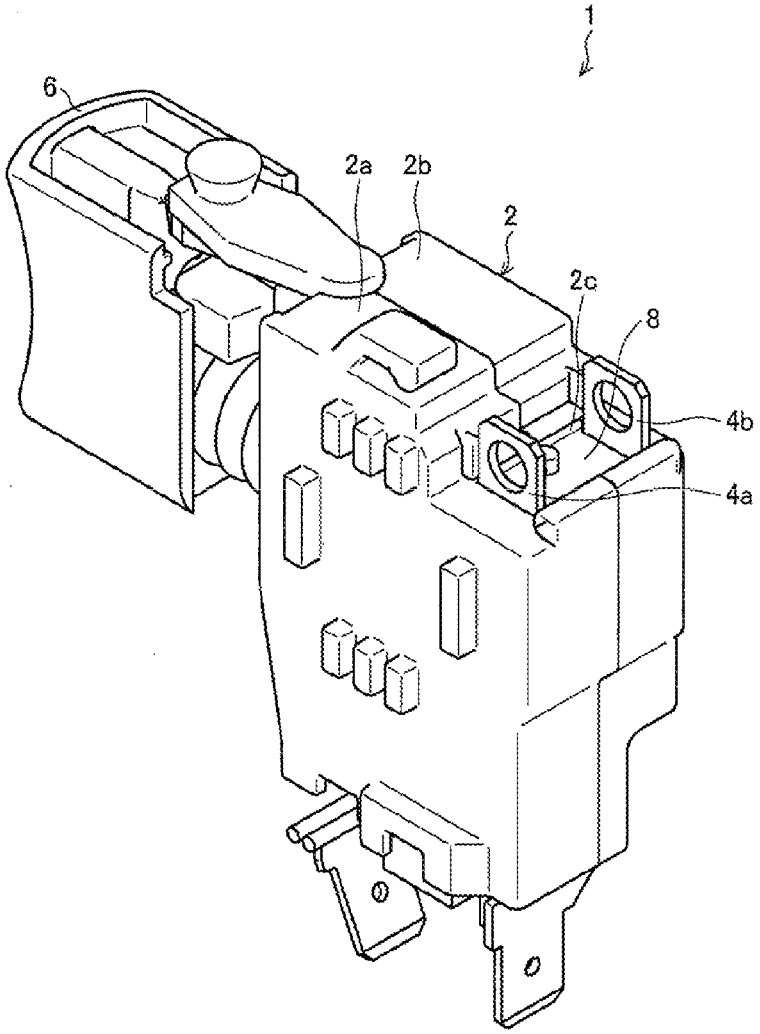
FIG. 10 is a perspective view illustrating an assembly in which only a pressing member and nuts are excluded from the trigger switch.

FIG. 10 is a perspective view illustrating the assembly in which only pressing member 5 and nuts 9 are excluded (are not illustrated) from trigger switch 1 for the purpose of the description of opening 2*c*. Opening 2*c* is formed between casing members 2*a* and 2*b*. Because parts of external terminals 4*a* and 4*b* project toward the outside of case 2 from opening 2*c* in assembled trigger switch 1. Therefore, walls of casing members 2*a* and 2*b* do not present between external terminals 4*a* and 4*b*. Accordingly, as in the embodiment, it is necessary that the whole of opening 2*c* be sealed by gasket 8.

The positions of external terminals 4*a* and 4*b* and the shape of opening 2*c* are possibly restricted depending on a relationship with the motor to which trigger switch 1 is to be connected or for the sake of assembly of a molding product. Therefore, sometimes the two openings fit to the sectional shapes of the external terminals cannot be provided in the case.

On the other hand, two external terminals 4*a* and 4*b* are arranged in one opening 2*c* in the embodiment. In this configuration, terminal unit 3 assembled as one unit component can be assembled in casing members 2*a* and 2*b* by sliding terminal unit 3 in parallel with the upper surface (planar surface) of plate-like gasket 8. Therefore, an assembly procedure can be simplified to improve the assembly workability. No gap is formed by external terminals 4*a* and 4*b* and through-holes 8*a* and 8*b* of gasket 8 in a manner such that the region between external terminals 4*a* and 4*b* is pressed against gasket 8 by pressing member 5. Therefore, the liquid-tightness can be ensured at the positions where external terminals 4*a* and 4*b* of the case are located. Accordingly, trigger switch 1 of the embodiment has good assembly workability as well as the liquid-tightness at the positions where external terminals 4*a* and 4*b* are located.

The present invention is not limited to the embodiment, but various changes can be made without departing from the scope of the invention. An embodiment obtained by a proper combination of the disclosed technical means is also included in the technical scope of the invention.

INDUSTRIAL APPLICABILITY

The present invention can be applied to a trigger switch of an electric power tool.

The invention provides a switch unit that has the good assembly workability and the liquid-tightness at the position where the external connection terminal of the case is located.

A switch unit of the present invention includes a case, two terminals, a gasket, a base member, and a pressing member. The case includes an opening and a switch. The two terminals partially project to an outside of the case from the opening. The gasket is configured to seal the opening and includes two through-holes through which the terminals extend. The pressing member is arranged between the terminals. In the switch unit, the through-holes are in close contact with surroundings of the piercing terminals. A region between the through-holes of the gasket is pressed while nipped between the pressing member and the base member. A surrounding region in the gasket is pressed while nipped between an inside surface of the case and the base member.

According to the configuration, the two terminals projecting from the case are arranged in the opening, so that a degree of freedom in design of the case and the assembly workability can be improved. The region between the through-holes in the gasket is pressed by the pressing member, and the surrounding region in the gasket is pressed by the inside surface of the case. The surrounding region is the region outward from the through-holes and outward from the region between the through-holes. Therefore, the state in which the through-holes of the gasket are in close contact with the terminals piecing therethrough can be maintained. Accordingly, the liquid-tightness of the case can be ensured even if two terminals separated from each other are arranged in one opening of the case.

In the switch unit, two side surfaces opposed to each other in the gasket may be pressed by the case.

According to the configuration, the two side surfaces opposed to each other in the gasket are pressed by the case, the through-holes come into close contact with the terminals. For example, the case presses the side surfaces of the gasket toward the center direction of the gasket from the sides of the gasket.

In the switch unit, side surfaces of all walls in the gasket may be pressed by the case.

In the switch unit, the case may be constructed by a combination of two casing members, and the opening may be formed between the casing members.

In the switch unit, a terminal unit may be an assembly including the two terminals, the gasket, the base member, and the pressing member. The gasket may have a plate-like shape, and the terminal unit may be assembled in the casing members by sliding the terminal unit in parallel with a planar surface of the gasket.

According to the configuration, the assembled terminal unit may be assembled in the casing members by sliding the terminal unit, so that the assembly workability can be improved.

In the switch unit, a height of at least the base member and the gasket overlapping each other may be restricted in a space in the casing members in which the terminal unit is arranged.

According to the configuration, the height of the base member and the gasket overlapping each other is restricted. Therefore, the gasket is pressed in a manner such that the terminal unit is arranged in the casing members by sliding the terminal unit.

In the switch unit, the pressing member may include a projection, and an edge of the opening of the case may press the projection of the pressing member against the gasket side.

According to the present invention, the liquid-tightness of the case can be ensured while the assembly workability is improved.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A switch unit comprising:

a case that comprises an opening and a switch;

two terminals that partially project to an outside of the case from the opening;

a gasket configured to seal the opening, the gasket comprising two through-holes through which the terminals extend;

a base member; and a pressing member that is arranged between the terminals, wherein the gasket is in close contact with the terminals at the through-holes, a region between the through-holes of the gasket is pressed while nipped between the pressing member and the base member, wherein a planar lower surface of the pressing member presses a central portion of an upper surface of the gasket; and a surrounding region in the gasket is pressed while nipped between an inside surface of the case and the base member.

2. The switch unit according to claim 1, wherein two side surfaces opposed to each other in the gasket are pressed by the case.

3. The switch unit according to claim 2, wherein side surfaces of all walls in the gasket are pressed by the case.

4. The switch unit according to claim 1, wherein the case is constructed by a combination of two casing members, and the opening is formed between the casing members.

5. A switch unit comprising:

a case that comprises an opening and a switch;

two terminals that partially project to an outside of the case from the opening;

a gasket configured to seal the opening, the gasket comprising two through-holes through which the terminals extend;

a base member; and a pressing member that is arranged between the terminals, wherein the gasket is in close contact with the terminals at the through-holes, a region between the through-holes of the gasket is pressed while nipped between the pressing member and the base member, and a surrounding region in the gasket is pressed while nipped between an inside surface of the case and the base member;

wherein the case is constructed by a combination of two casing members, and the opening is formed between the casing members; and wherein a terminal unit is an assembly comprising the two terminals, the gasket, the base member, and the pressing member, the gasket has a plate-like shape, and the terminal unit is assembled in the casing members by sliding the terminal unit in parallel with a planar surface of the gasket.

6. The switch unit according to claim 5, wherein a height of at least the base member and the gasket overlapping each other is restricted in a space in the casing members in which the terminal unit is arranged.

7. The switch unit according to claim 5, wherein the pressing member comprises a projection, and an edge of the opening of the case presses the projection of the pressing member against the gasket side.

8. The switch unit according to claim 2, wherein the case is constructed by a combination of two casing members, and the opening is formed between the casing members.

9. The switch unit according to claim 3, wherein the case is constructed by a combination of two casing members, and the opening is formed between the casing members.

10. A switch unit comprising:

a case that comprises an opening and a switch;

two terminals that partially project to an outside of the case from the opening;

a gasket configured to seal the opening, the gasket comprising two through-holes through which the terminals extend;

a base member; and a pressing member that is arranged between the terminals, wherein the gasket is in close contact with the terminals at the through-holes, a region between the through-holes of the gasket is pressed while nipped between the pressing member and the base member, and a surrounding region in the gasket is pressed while nipped between an inside surface of the case and the base member;

wherein two side surfaces opposed to each other in the gasket are pressed by the case;

wherein the case is constructed by a combination of two casing members, and the opening is formed between the casing members; and wherein a terminal unit is an assembly comprising the two terminals, the gasket, the base member, and the pressing member, the gasket has a plate-like shape, and the terminal unit is assembled in the casing members by sliding the terminal unit in parallel with a planar surface of the gasket.

11. The switch unit according to claim 9, wherein a terminal unit is an assembly comprising the two terminals, the gasket, the base member, and the pressing member, the gasket has a plate-like shape, and the terminal unit is assembled in the casing members by sliding the terminal unit in parallel with a planar surface of the gasket.

12. The switch unit according to claim 10, wherein a height of at least the base member and the gasket overlapping each other is restricted in a space in the casing members in which the terminal unit is arranged.

13. The switch unit according to claim 11, wherein a height of at least the base member and the gasket overlapping each other is restricted in a space in the casing members in which the terminal unit is arranged.

14. The switch unit according to claim 10, wherein the pressing member comprises a projection, and an edge of the opening of the case presses the projection of the pressing member against the gasket side.

15. The switch unit according to claim 11, wherein the pressing member comprises a projection, and an edge of the opening of the case presses the projection of the pressing member against the gasket side.

16. The switch unit according to claim 12, wherein the pressing member comprises a projection, and an edge of the opening of the case presses the projection of the pressing member against the gasket side.

17. The switch unit according to claim 13, wherein the pressing member comprises a projection, and an edge of the opening of the case presses the projection of the pressing member against the gasket side.

* * * * *